United States Patent [19]

Ounuma

[11] Patent Number: 4,736,200

[45] Date of Patent: Apr. 5, 1988

[54] GRAPHIC PROCESSING APPARATUS WITH CLIPPING CIRCUIT

[75] Inventor: Shouji Ounuma, Tokyo, Japan

[73] Assignee: Tokyo Shibaura Denki Kabushiki Kaisha, Kawasaki, Japan

[21] Appl. No.: 554,105

[22] Filed: Nov. 21, 1983

[30] Foreign Application Priority Data

Nov. 25, 1982 [JP] Japan ..... 59-206617

[51] Int. Cl.[4] ..... G09G 1/16

[52] U.S. Cl. ..... 340/734; 340/721; 340/723; 340/803

[58] Field of Search ..... 340/723, 728, 801, 804, 340/744, 747, 734, 721

[56] References Cited

U.S. PATENT DOCUMENTS 4,243,987 1/1981 Bobick ..... 340/801
4,437,093 3/1984 Bradley ..... 340/747
4,492,956 1/1985 Collmeyer et al. ..... 340/747
4,545,070 10/1985 Miyagawa et al. ..... 340/723
4,586,036 4/1986 Thomason et al. ..... 340/721

FOREIGN PATENT DOCUMENTS 148247 3/1981 Japan .
57-74779 5/1982 Japan .
57-78289 5/1982 Japan .

*Primary Examiner*—Gerald L. Brigance
*Assistant Examiner*—Jeffery A. Brier
*Attorney, Agent, or Firm*—Cushman, Darby & Cushman

[57] ABSTRACT

A graphic apparatus of the invention having a clip function includes a clip register storing coordinates of points defining a display designation clip area. The contents of the clip register and an address supplied to a bit map memory are compared by a comparator. Control operation for clipping is performed such that only data falling within the clip area is written in the bit map memory in accordance with the comparison result of the comparator.

3 Claims, 8 Drawing Sheets

Xsdot

| | | | | | | | | | | | | | | | |
|---|---|---|---|---|---|---|---|---|---|---|---|---|---|---|---|
| 0 | 0 | 0 | 0 | 0 | 0 | 1 | 1 | 1 | 1 | 1 | 1 | 1 | 1 | 1 | 1 |

105

| | | | | | | | | | | | | | | | |
|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 |

102

| | | | | | | | | | | | | | | | |
|---|---|---|---|---|---|---|---|---|---|---|---|---|---|---|---|
| 1 | 1 | 0 | 0 | 1 | 1 | 0 | 0 | 1 | 1 | 0 | 0 | 1 | 1 | 0 | 0 |

530

| | | | | | | | | | | | | | | | |
|---|---|---|---|---|---|---|---|---|---|---|---|---|---|---|---|
| 1 | 1 | 0 | 0 | 1 | 1 | 1 | 1 | 1 | 1 | 1 | 1 | 1 | 1 | 1 | 1 |

GRAPHIC PROCESSING APPARATUS WITH CLIPPING CIRCUIT

BACKGROUND OF THE INVENTION

The present invention relates to a graphic apparatus which realizes clipping with simple hardware.

In a graphic apparatus, data is processed so as to display a figure expressed within a predetermined coordinate plane within a specific region on a screen. In this case, this specific region is generally a square region having sides parallel to the x- and y-axes. Processing for eliminating the portion of the figure falling outside this region is termed windowing. Clipping is generally known as one of windowing techniques.

FIG. 1 is a block diagram showing a partial configuration of a conventional graphic apparatus which realizes clipping. Referring to FIG. 1, an arithmetic unit 11 performs various arithmetic operations for graphics processing. A bit map memory 12 stores data corresponding to a graphic pattern. The bit map memory 12 generally has a one-dimensional address space and the addresses logically correspond to the coordinate plane for developing a figure. Data to be written in the bit map memory 12 is temporarily stored in a register 15 through a common data bus 101 and is then supplied to the bit map memory 12. The data read out from the bit map memory 12 is supplied to an output controller 17 which supplies display data to a CRT display unit. The data read out from the bit map memory 12 is also temporarily stored in a register 16 and is then supplied to the common data bus 101.

The read and write operations of data into and from the bit map memory 12 as described above are controlled by a memory controller 13. The memory controller 13 receives a control signal m1 from the arithmetic unit 11 through a control bus 103 and also receives a control signal m2 from a display controller 18. In accordance with these signals, the memory controller 13 controls the read and write operations of data into and from the bit map memory 12. In response to an address supplied through an address bus 102, a memory address controller 14 supplies to the bit map memory 12 a read address or a write address of the bit map memory 12.

In the bit map memory 12, as shown in FIG. 2, one word consists of 16 bits and memory locations from address 0 to address 8191 are allocated. The capacity of the bit map memory 12 corresponds to the effective screen area of the CRT display unit. The screen of the CRT unit has 512 dots in the horizontal direction and 256 dots in the vertical direction, as shown in FIG. 2. FIG. 3 shows the state wherein the contents of the bit map memory 12 are updated upon drawing graphic elements. For example, when a straight line 30 is first drawn and then a straight line 31 is drawn, contents 32 of the bit map memory 12 corresponding to a portion of the line surrounded by a thick slice i are changed to contents 33.

A coordinate plane as shown in FIG. 4 is considered in the graphic apparatus as described above. A rectangular area defined in the coordinate plane by points of coordinates Ps (Xs, Ys) and Pe (Xe, Ye) will be referred to as a clip area 40. The clip function allows development (i.e., display) of a figure within the clip area 40 alone. More specifically, when a straight line connecting points of coordinates P1 (X1, Y1) and P2 (X2, Y2) is drawn, as shown in FIG. 4, the arithmetic unit 11 calculates a point Pi (Xi, Yi) between the two points $P_1$ and $P_2$ in accordance with an equation (1) below:

$$Y=(Y2-Y1)\cdot(X-Xi)/(X2-X1)+Yi \quad (1)$$

The contents (M) at the address of the bit map memory 12 which are converted in accordance with an equation (3) below in correspondence with a point Pi (Xi, Yi) satisfying relations (2) below are fetched in the arithmetic unit 11:

$$Xs \leqq Xi \leqq Xe,\ Ys \leqq Yi \leqq Ye \quad (2)$$

$$M=32Y+[X/16] \quad (3)$$

where [X/16] is an integral part of X/16. The arithmetic unit 11 creates data with set bit data (B) given by an equation (4) below:

$$B=X-16(n-1) \quad (4)$$

where n is an integer of 1 or more which renders the right side of the equation (4) minimum. The data processed in this manner is stored at the original address of the bit map memory 12 through the register 15 from which it was read out. Then, the line segment within the clip area 40 alone (i.e., between the points $P_1$ and $P_3$) is displayed, and the clip function is completed.

However, in a conventional graphic apparatus, such a clip function as described above is performed under program control of the arithmetic unit (generally comprising a microprocessor). This results in a low graphic processing speed and a complex program being stored in the arithmetic unit.

SUMMARY OF THE INVENTION

It is an object of the present invention to provide a graphic apparatus which realizes clipping with simple hardware, simplifies a program to be stored in an arithmetic unit, and performs high-speed graphics processing.

According to the graphic apparatus of the present invention, a clip register stores coordinates of a point which define a predetermined display designation area in a coordinate plane. A bit map memory storing a graphic pattern has addresses which logically correspond to the coordinate plane. An address supplied to the bit map memory and the coordinates of a point set in the clip register are compared by a comparator so as to determine whether the address falls within the display designation area. In accordance with the discrimination result obtained from the comparator, only data falling within the display designation area are written in the bit map memory under the control of a memory controller.

With the graphic apparatus of this configuration, clipping can be performed at high speed by simple hardware such as a clip register, a comparator and the like. This realizes high-speed graphics processing and simplifies a program to be stored in the arithmetic unit.

DETAILED DESCRIPTION OF THE PREFERRED EMBODIMENTS

Figure 1:
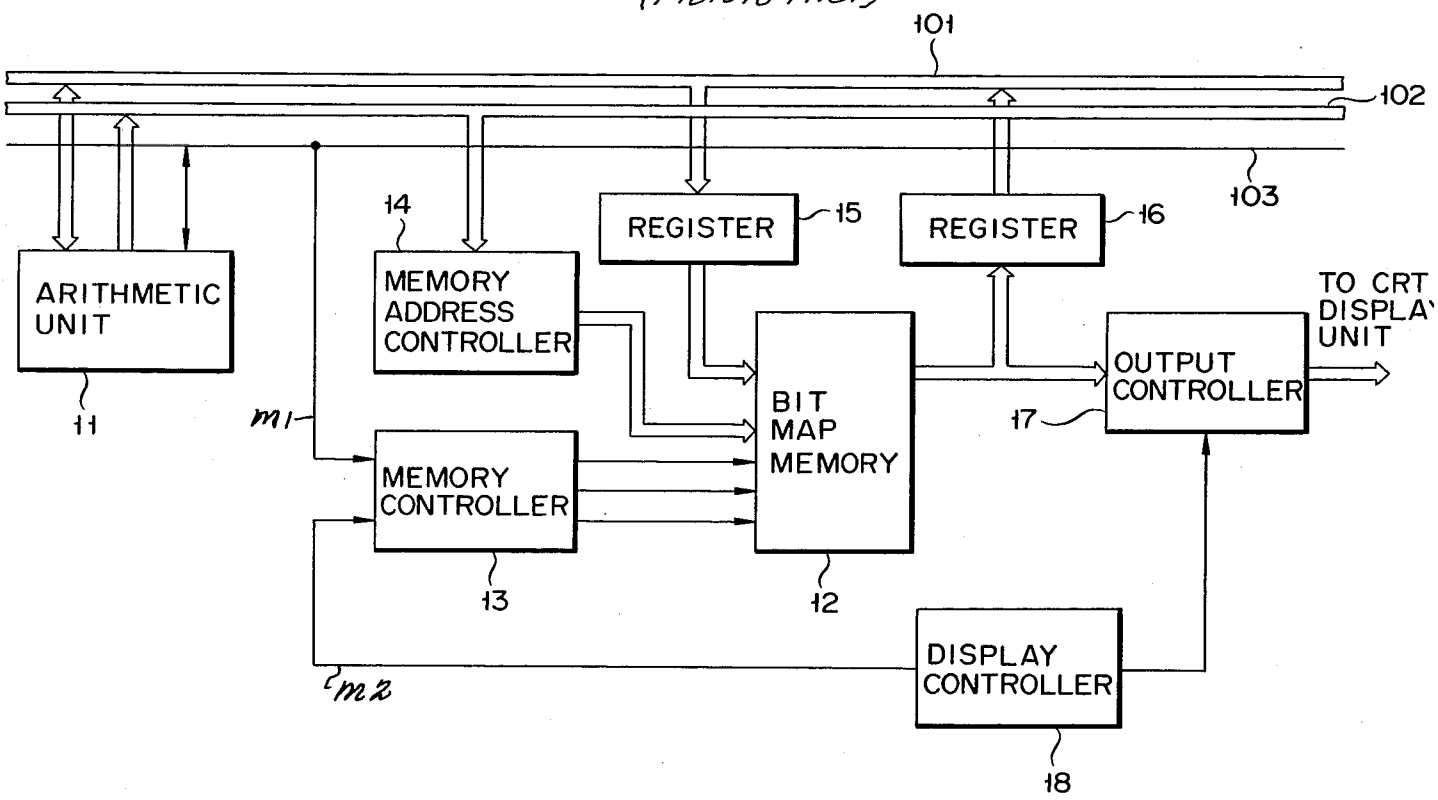
FIG. 1 (PRIOR ART)
FIG. 1 is a block diagram showing the configuration of a conventional graphic apparatus.
Figure 2:
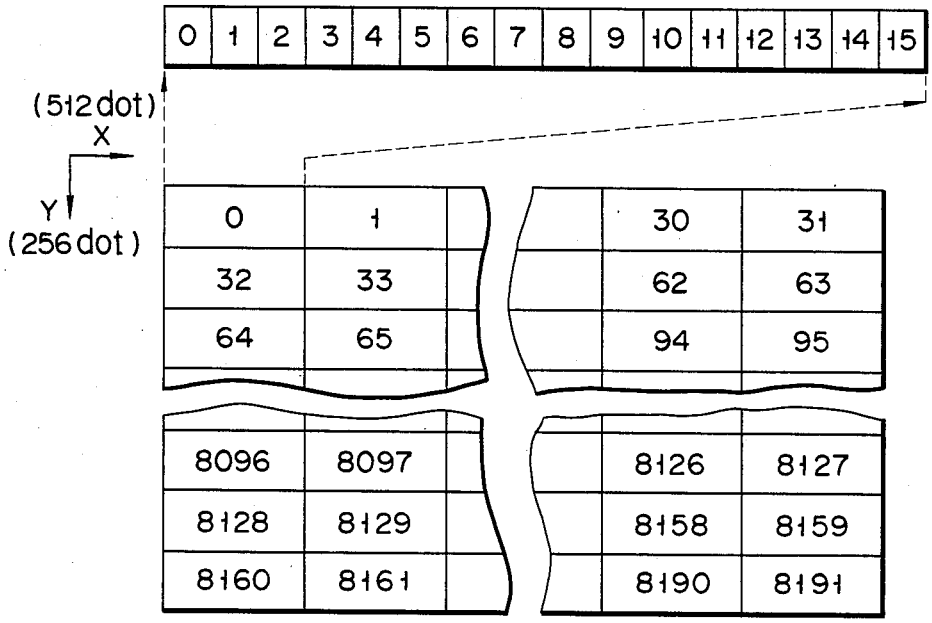
FIG. 2 is a representation showing correspodence between a display screen and a bit map memory.
Figure 3:
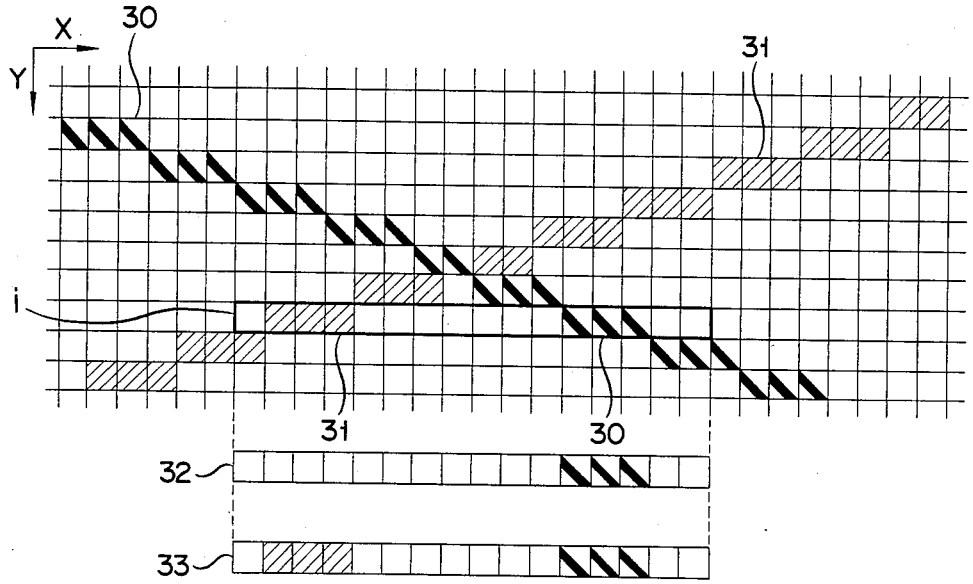
FIG. 3 shows the state wherein the contents of the bit map memory are updated upon drawing of a graphic element.
Figure 4:
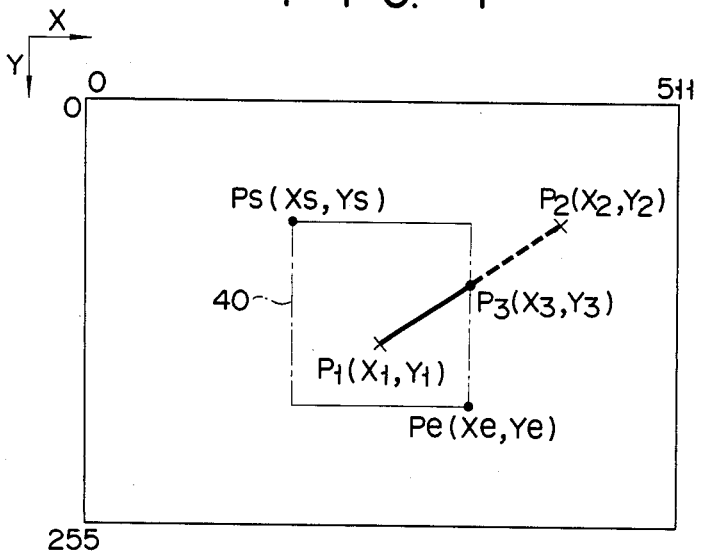
FIG. 4 is a representation for explaining the clip function utilizing the coordinate plane.
Figure 5:
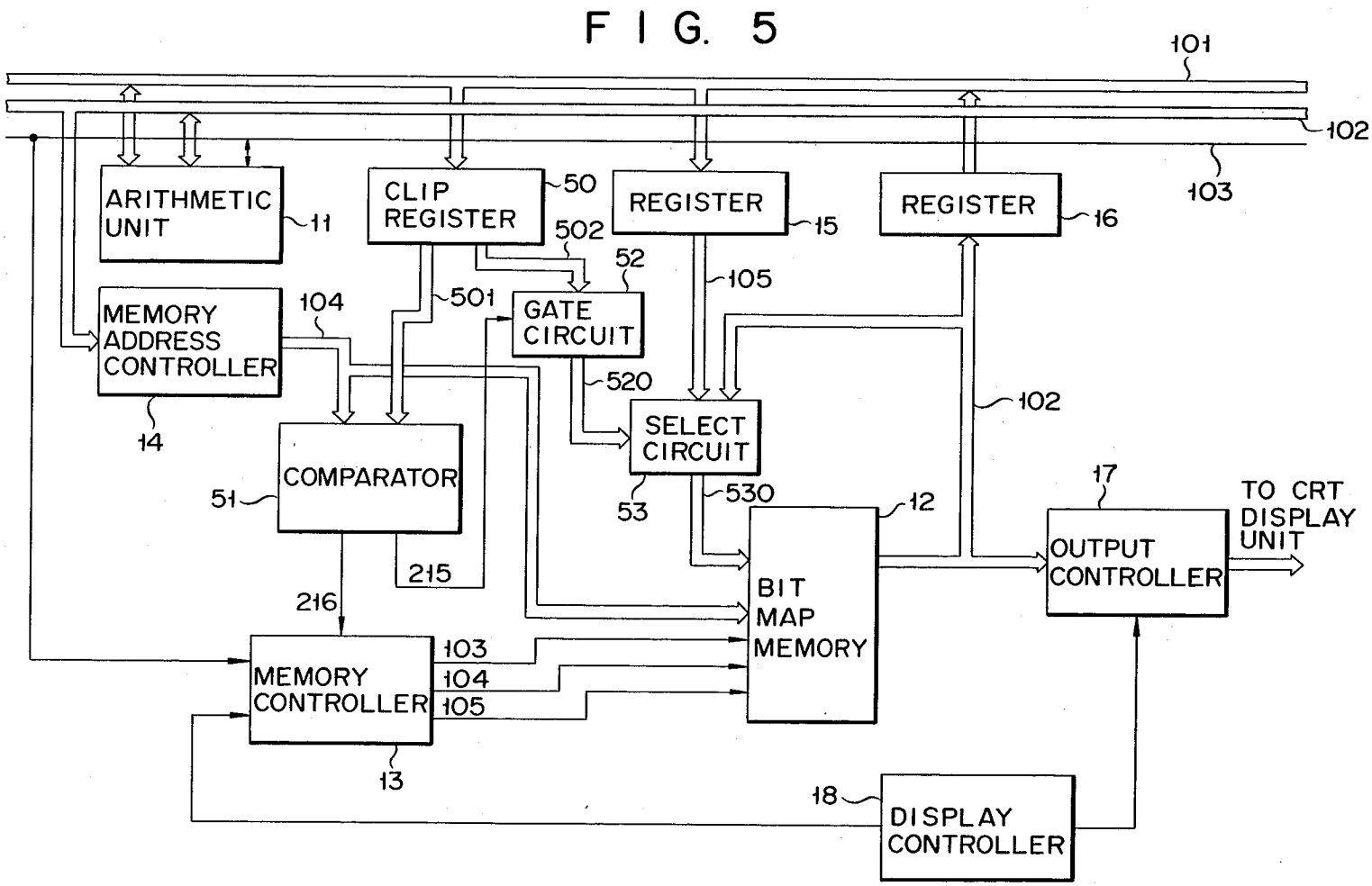
FIG. 5 is a block diagram showing the configuration of a graphic apparatus according to an embodiment of the present invention.

The first embodiment of the present invention will be described with reference to FIGS. 5 to 10. FIG. 5 is a block diagram showing the configuration of a graphic apparatus according to the first embodiment. Referring to FIG. 5, an arithmetic unit 11 performs various arithmetic operations necessary for graphics processing. A clip register 50 stores coordinates of predetermined points which are supplied from the arithmetic unit 11 through a common data bus 101. The coordinates of the points are data for defining a predetermined display designation area in a coordinate plane (space corresponding to a screen area). The coordinates of the points set in the clip register 50 are supplied to a comparator 51 as one input thereto. The comparator 51 receives as its other input an address of a bit map memory 12 from a memory address controller 14. The comparator 51 compares the two inputs and supplies a control signal 215 to a gate circuit 52 and a control signal 216 to a memory controller 13 in accordance with the comparison result. The gate circuit 52 controls transfer of the contents in the clip register 50 to a select circuit 53 in accordance with the control signal 215 from the comparator 51. In accordance with an output signal from the gate circuit 52, the select circuit 53 selects one of the data supplied from the arithmetic unit 11 through the common data bus 101 and the data read out from the bit map memory 12. The select circuit 53 then supplies the selected data to the bit map memory 12.

The bit map memory 12 has addresses which logically correspond to a coordinate plane corresponding to a display screen of a CRT display unit, for example. The bit map memory 12 stores the data (i.e., graphic pattern) from the select circuit 53 at an address corresponding to the address signal supplied from the memory address controller 14. The memory address controller 14 receives address signals from the arithmetic unit 11 through a address bus 102. Data read out from the bit map memory 12 is supplied to a CRT display unit, for example, as display data. The read and write operations of data into and from the bit map memory 12 are controlled by the memory controller 13. Reference numerals 103 to 105 denote memory control signals RD, WR and CE supplied from the memory controller 13 to the bit map memory 12.

Figure 6:
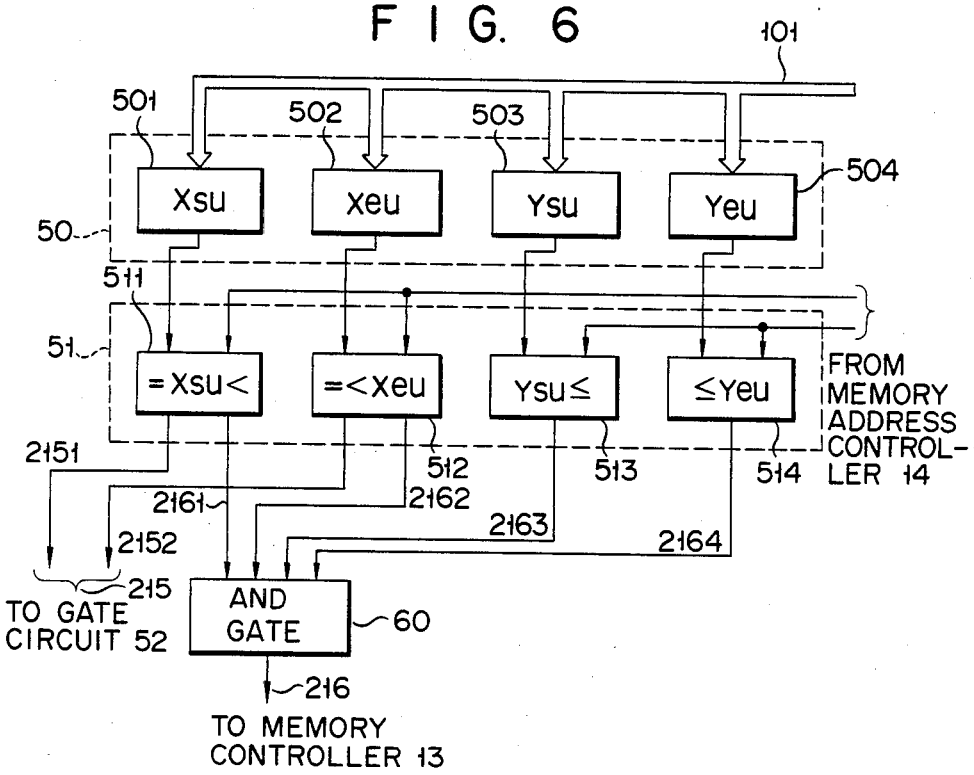
FIG. 6 is a circuit diagram showing the details of circuit portions surrounding a clip register and a comparator of the apparatus shown in FIG. 5.

FIG. 6 is a block diagram showing circuit portions surrounding the clip register 50 and the comparator 51 of the apparatus shown in FIG. 5. The clip register 50 includes a plurality of registers 501 to 504 (others also included), which respectively store coordinates Xsu, Xeu, Ysu and Yeu for defining a clip area. Note that a clip area is a predetermined display designation area 40 (FIG. 9) for realizing clipping. The comparator 51 consists of a plurality of comparators 511 to 514. Each of the comparators 511 to 514 compares the corresponding one of the coordinates Xsu, Xeu, Ysu and Yeu from the clip register 50 with an address (X, Y) from the memory address controller 14. More specifically, the comparator 511 compares Xsu with X. If they coincide, the comparator 511 supplies a control signal 2151 to the gate circuit 52. If Xsu is smaller than X, the comparator 511 supplies a control signal 2161 to an AND gate 60. The comparator 512 compares Xeu and X. If they coincide, the comparator 512 supplies a control signal 2152 to the gate circuit 52. If Xeu is greater than X, the comparator 512 supplies a control signal 2162 to the AND gate 60. The comparator 513 compares Ysu with Y. If they coincide or Ysu is greater than Y, the comparator 513 supplies a control signal 2163 to the AND gate 60. The comparator 514 compares Yeu with Y. If they coincide or Yeu is greater than Y, the comparator 514 supplies a control signal 2164 to the AND gate 60. An output signal 216 from the AND gate 60 is supplied to the memory controller 13.

Figure 7:
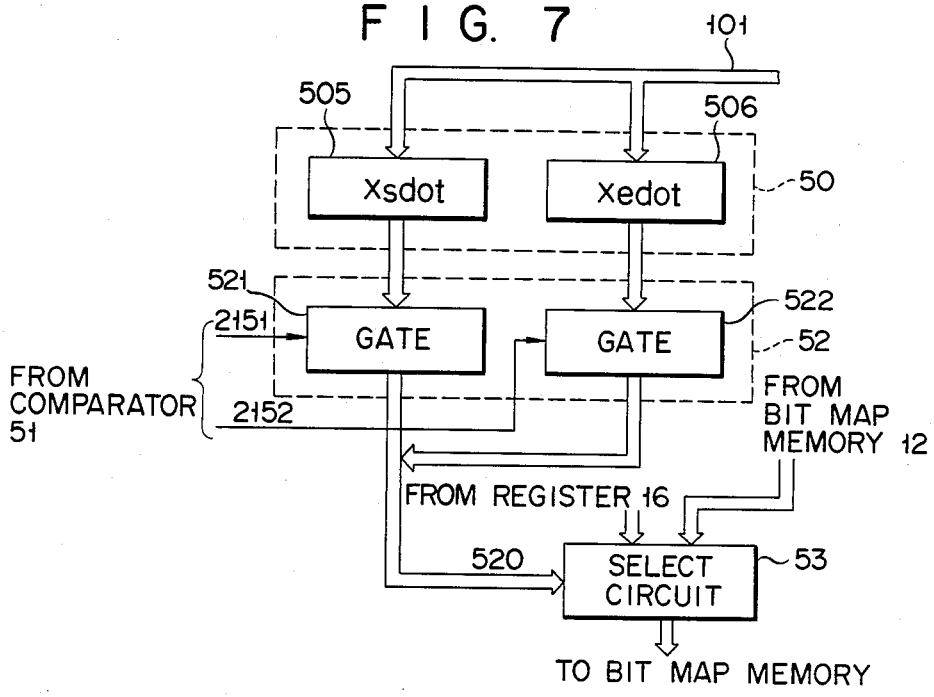
FIG. 7 is a circuit diagran showing the details of circuit portions surrounding a gate circuit, a select circuit, and the clip register of the apparatus shown in FIG. 5.

FIG. 7 is a block diagram showing details of the circuit portions surrounding the gate circuit 52, the select circuit 53 and the clip register 50 of the apparatus shown in FIG. 5. Coordinates Xsdot and Xedot are set in registers 505 and 506 (separate registers from the registers 501 to 504 shown in FIG. 6) of the clip register 50. The coordinates Xsdot and Xedot are 16-bit data which are obtained based on the lower four bits of the coordinates Xs and Xe, for example, shown in FIG. 9. Note that Xsu and Xeu consist of the upper bits of Xs and Xe from which the lower four bits have been removed. The contents of the registers 505 and 506 are respectively supplied to gates 521 and 522 of the gate circuit 52. In response to the control signals 2151 and 2152 from the comparator 51, the gates 521 and 522 control to transfer the contents in the registers 505 and 506 to the select circuit 53.

Figure 8:
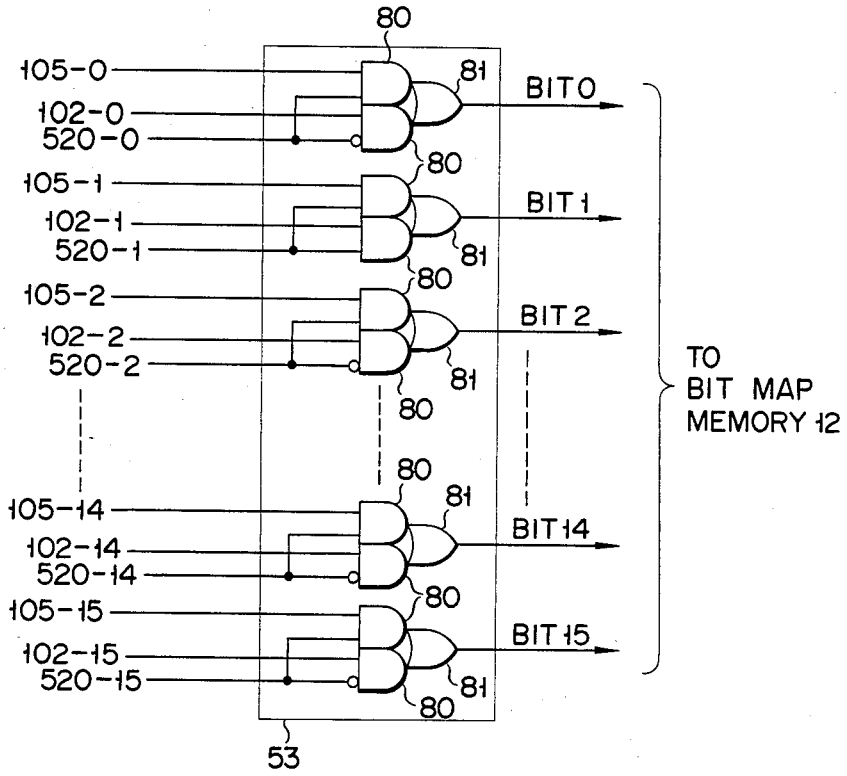
FIG. 8 is a circuit diagram showing the details of the select circuit of the apparatus shown in FIG. 5.

The select circuit 53 comprises, for example, a circuit as shown in FIG. 8. More specifically, the select circuit 53 comprises a combination of an AND gate 80 and an OR gate 81. In response to an output signal 520 (520-0 to 520-15) from the gate circuit 52, the select circuit 53 selects one of data 105 (105-0 to 105-15) from the register 15 and data 102 (102-0 to 102-15) from the bit map memory 12 and supplies the selected data to the bit map memory 12.

Figure 9:
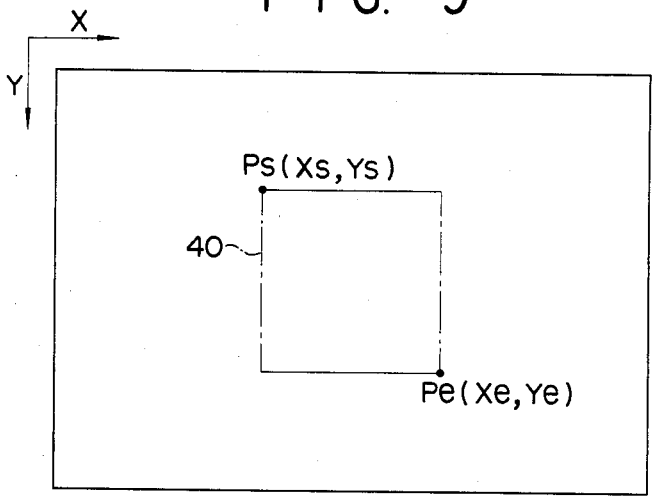
FIG. 9 is a representation for explaining the clip function in the apparatus shown in FIG. 5.

The mode of operation of the graphic apparatus having the configuration as described above will now be described. First, when a clip area 40 as shown in FIG. 9 is designated, the coordinates Xsu, Ys, Xeu, and Ye and Xsdot and Xedot defining this clip area 40 are calculated by the arithmetic unit 11 and are supplied to the registers 501 to 506 of the clip register 50, respectively. When a point having coordinates (Xi, Yi) is to be plotted on the screen as shown in FIG. 9, a predetermined address of the bit map memor 12 corresponding to the coordinates is produced from the arithmetic unit 11 and is supplied to the memory address controller 14. The predetermined address is an address of the bit map memory 12 from which the data of set bits corresponding to (Xi, Yi) is read out and into which the data is stored again.

The address supplied from the memory address controller 14 to the bit map memory 12 is also supplied to one input terminal of the comparator 51. The other input terminal of the comparator 51 receives the contents of the clip register 50. When the comparator 51 determines that the address falls within the clip area 40, it produces a control signal 216 for enabling memory write to the memory controller 13. As shown in FIG. 6, when the address (corresponding to Xi, Yi) from the memory address controller 14 satisfies $Xsu \leqq Xi \leqq Xeu$ and $Ysu \leqq Yi \leqq Yeu$, the comparators 511 to 514 supply control signals 2161 to 2164 to the AND gate 60. The AND gate 60 then supplies a control signal 216 for enabling memory write to the memory controller 13.

When the comparator 51 determines that $Xsu = Xi$ (the lower four bits are not considered) and $Xeu = Xi$ (the lower four bits are not considered), the comparator 511 or 512 supplies a control signal 2151 or 2152 to the gate circuit 52. In accordance with the control signal 2151 or 2152, Xsdot or Xedot stored in the register 505 or 506 of the clip register 50 is transferred to the select circuit 53, as shown in FIG. 7.

In response to a select signal, that is, a signal 520, from the gate circuit 52 (e.g., in response to a signal 520 of logic level "1") to the select circuit 53, data 105 from the register 15 is selected and is supplied to the bit map memory 12. The data 105 from the register 15 is output data from the arithmetic unit 11. When the signal 520 is at logic level "0", the select circuit 53 selects output data 102 from the bit map memory 12 and returns it to the bit map memory 12. Then, those bits of Xsdot and Xedot of the clip registers 505 and 506 which are set at logic level "1" are updated. Subsequently, updated data 530 is rewritten in the bit map memory 12.

Figures 10A, 10B, 10C, 10D, 12:
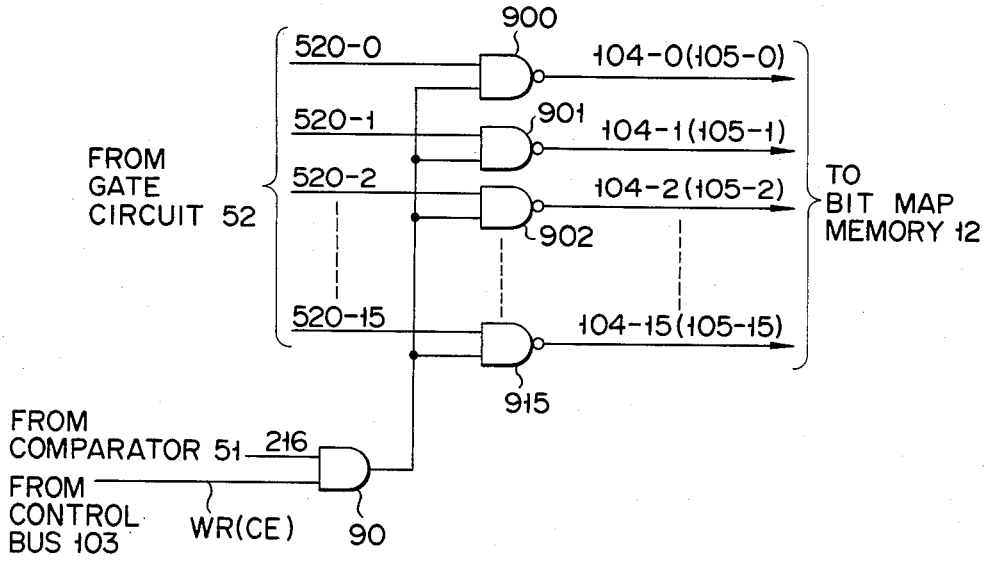
FIGS. 10*a* to 10*d* are representations for explaining the mode of operation of the graphic apparatus shown in FIG. 5.
FIG. 12 is a circuit diagram showing the partial configuration of a memory controller of the apparatus shown in FIG. 11.

When the address from the memory address controller 14 falls within the clip area 40 and $Xsu = Xi$ (excluding the lower four bits), those bits of Xsdot shown in FIG. 10*a* which are set at logic level "1" are replaced by output data 105 (FIG. 10*b*) from the arithmetic unit 11. Those bits of Xsdot which are set at logic level "0" are replaced by output data 102 (FIG. 10*c*) from the bit map memory 12. In this manner, for the bits corresponding to logic level "0" of Xsdot, the original contents of the bit map memory 12 are retained. In this manner, updated data 530 as shown in FIG. 10*d* is supplied from the select circuit 53 to the bit map memory 12.

On the other hand, when the address from the memory address controller 14 falls outside the clip area 40, no memory write enable signal 216 is supplied from the comparator 51 to the memory controller 13. Therefore, the contents of the bit map memory 12 are not updated.

Clipping is performed in the manner as described above. Then, a figure including points having coordinates Xi, Yi within the clip area 40 alone is displayed on the screen of the CRT display unit, as shown in FIG. 9.

Figure 11:
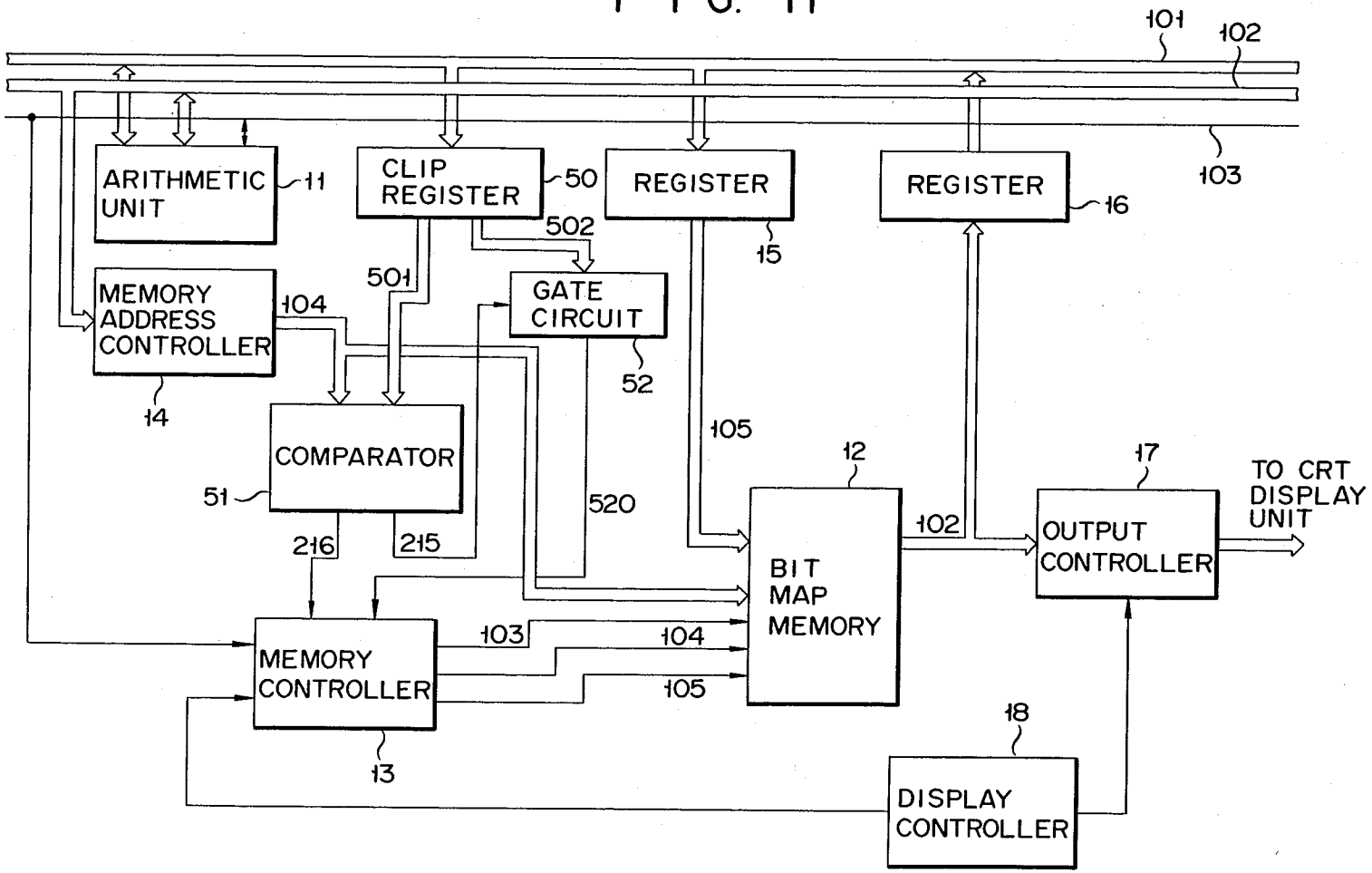
FIG. 11 is a block diagram showing the configuration of a graphic apparatus according to a second embodiment of the present invention.

FIG. 11 is a block diagram showing the configuration of a graphic apparatus according to a second embodiment of the present invention. In the second embodiment, as shown in FIG. 11, an output signal 520 from the gate circuit 52 is supplied to a memory controller 13. FIG. 12 is a circuit diagram showing the partial configuration of the memory controller 13 shown in FIG. 11. Output signals 520-0 to 520-15 from the gate circuit 52 are supplied to one input terminal of each of NAND gates 900 to 915. The other input terminal of each of the NAND gates 900 to 915 commonly receives an output signal from an AND gate 90. The AND gate 90 receives at its one input terminal an output signal 216 from a comparator 51 and at its other input terminal a memory control singal WR supplied through a control bus 103. Output signals 104-0 to 104-15 (or 105-0 to 105-15) from the NAND gates 900 to 915 are supplied to a bit map memory 12 as a memory control signal (write signal).

In the second embodiment shown in FIG. 11, when an address set by an arithmetic circuit 11 falls outside a clip area 40, no control signal 216 for enabling memory write is supplied from the comparator 51 to the memory controller 13 (the AND gate 90 shown in FIG. 12). Therefore, as shown in FIG. 12, the gate of the AND gate 90 is turned off, and memory control signals (memory write signals 104-0 to 104-15) are prohibited from being supplied from the NAND gates 900 to 915 to the bit map memory 12. The contents of the bit map memory 12 are not updated.

Assume that an output signal 520 (see FIG. 7) from the gate circuit 52 is supplied to the memory controller 13 when an address set by the arithmetic unit 11 falls within the clip area 40. This is the case wherein the NAND gates 900 to 915 respectively receive signals 520-0 to 520-15 corresponding to Xsdot or Xedot from the clip register 50 and the gate of the AND gate 90 is turned on by the control signal 216 from the comparator 51. Then, memory write signals 104-0 to 104-15 corresponding to those bits of Xsdot or Xedot set in the clip register 505 or 506 which are set at logic level "1" are supplied to the bit map memory 12 from the NAND gates 900 to 915. Thus, the contents of the bit map memory 12 corresponding to the bits of the memory write signals 104-0 to 104-15 are updated.

When an address set by the arithmetic unit 11 falls within the clip area 40 and signals 520-0 to 520-15 are not supplied from the gate circuit 52 to the NAND gates 900 to 915, all bits of memory write signals 104-0 to 104-15 are supplied from the NAND gates 900 to 915 to the bit map memory 12. In this manner, all bits of the contents of the bit map memory 12 are updated.

In the second embodiment as described above, clipping is performed by controlling an output of the memory write signal 104 from the memory controller 14.

The present invention is not limited to CRT display units described with reference to the first and second embodiments as described above, and may be generally applied to any other types of graphic apparatuses such as a serial printer or a laser beam printer.

What is claimed is:

1. A graphic apparatus comprising:

means for displaying a graphic pattern;

bit map memory means for storing graphic data indicative of said graphic pattern at addresses corresponding to a coordinate plane of said display means;

clip register means for storing coordinates which define a predetermined clip area in said coordinate plane within which a different pattern is desired to be displayed;

a comparator for comparing said coordinates in said clip register means with said addresses to determine if said addresses fall within said predetermined clip area;

memory control means for selectively controlling a write operation of said graphic data into said bit map memory means based on a comparison signal from said comparator;

select means for receiving: (1) output data from said bit map memory means as first input data, and (2) data corresponding to said different graphic pattern as second input data, and for selecting one of said first and second input data and supplying said selected data to said bit map memory means; and select control means for controlling said select means to produce one of: (a) all bits of said first input data, when said addresses of said bit map memory means are outside said clip area, or (b) predetermined bits of said first input data corresponding to said graphic pattern and predetermined bits of said second input data corresponding to said different graphic pattern, said predetermined bits of said second input data replacing bits in said clip area other than said predetermined bits of said first input data when said addresses of said bit map means are within said clip area, in accordance with the coordinates stored in said clip register means in response to said comparison signal from said comparator.

2. A graphic apparatus according to claim 1, wherein said memory control means has a gate circuit which is coupled to said bit map memory means to produce a memory write signal, a number of bits of the memory write signal being determined by both said comparison signal from said comparator and said coordinates from said clip register means.

3. Apparatus as in claim 1 wherein said clip register means includes a plurality of registers, each for storing a coordinate defining a boundary of said clip area, said apparatus further comprising a plurality of comparators, each comparator being coupled to one of said registers, and to said addresses, so that parallel processing is performed to determine if said addresses are within said clip area.

* * * * *

UNITED STATES PATENT AND TRADEMARK OFFICE

CERTIFICATE OF CORRECTION

PATENT NO. : 4,736,200

DATED : April 5, 1988

INVENTOR(S) : OUNUMA

It is certified that error appears in the above-identified patent and that said Letters Patent is hereby corrected as shown below:

ON THE TITLE PAGE, LINE [30], PRIORITY DATA, THE DOCUMENT NUMBER READS "59-206617" THIS NUMBER SHOULD READ --57-206617--.

Signed and Sealed this

Fourth Day of October, 1988

*Attest:*

*Attesting Officer*

DONALD J. QUIGG

*Commissioner of Patents and Trademarks*